United States Patent [19]

Blomgren et al.

[11] 4,443,891

[45] Apr. 24, 1984

[54] BICYCLE HELMET

[76] Inventors: Rolf Blomgren, 131 Lövängsvägen, Täby, Sweden, S-130; Ove Johnson, 68 Gotlandsgatan, Stockholm, Sweden, S-116

[21] Appl. No.: 341,995

[22] PCT Filed: May 21, 1981

[86] PCT No.: PCT/SE81/00151

§ 371 Date: Jan. 15, 1982

§ 102(e) Date: Jan. 15, 1982

[87] PCT Pub. No.: WO81/03267

PCT Pub. Date: Nov. 26, 1981

[30] Foreign Application Priority Data

May 22, 1980 [SE] Sweden ..... 8003831

[51] Int. Cl.[3] ..... A61F 9/02

[52] U.S. Cl. ..... 2/414; 2/420; 2/425; 2/192; 2/209.3

[58] Field of Search ..... 2/410, 411, 412, 413, 2/414, 415, 417, 418, 419, 420, 421, 423, 425, 209.3, 192

[56] References Cited

U.S. PATENT DOCUMENTS

| | | | |
|---|---|---|---|
| 1,631,210 | 6/1927 | Johnson | 2/209.3 X |
| 2,969,547 | 1/1961 | Dye | 2/411 |
| 3,283,349 | 11/1966 | White | 2/421 X |
| 3,551,911 | 1/1971 | Holden | 2/411 |
| 3,629,864 | 12/1971 | Latina | 2/420 |
| 4,293,960 | 10/1981 | Palmaer | 2/420 |

*Primary Examiner*—Peter P. Nerbun

*Attorney, Agent, or Firm*—Burns, Doane, Swecker & Mathis

[57] ABSTRACT

This invention relates to a helmet for cyclists, skateboard runners and roller skaters. It comprises a shell of flexible and hard plate-shaped material and a damping means attached inside the shell. The shell in its plane has the form of an I, with extended cross-pieces (3) and with tips (3) attached radially between the same, which tips extend from the connecting between the cross-pieces and the stem of the I. About at the center of said stem lateral tips are attached to both sides. The cross-pieces and tips are provided with attachment means in such a manner, that the free ends of one cross-piece after the bending of the stem can be connected to the free ends of the other cross-piece. The free ends of the tips can be attached to suitable holders on the lateral tips.

The cross-pieces, tips and lateral tips can be designed as bands, and the attachment means be arranged so that the width and size of the shell can be adjusted. The damping means substantially is formed after the stem and lateral tips and is provided with lugs arranged so as to protect the temples. The shell preferably is made of plastic, and the damping means of foamed plastic.

5 Claims, 4 Drawing Figures

BICYCLE HELMET

This invention relates to a helmet, preferably adapted for cyclists, but also for skateboard runners and roller skaters.

It has become popular to cycle, but unfortunately the number of bicycle accidents has increased thereby. According to an investigation of the number of accidents, in which children up to 15 years' age were involved, bicycle accidents ranked as the second greatest group. In order to reduce the risks at such accidents, therefore, helmets have come into use, which are recommended also for adult cyclists, especially those participating in the traffic in greater cities.

A helmet for cyclists, skateboard runners or roller skaters must meet certain requirements. The helmet must provide good ventilation, because its wearer advancing by his own efforts gets warm and begins to sweat more readily than a mopedist or a motor-cyclist. The helmet, furthermore, should be adjustable and of low weight. It should not appreciably screen off sound nor reduce or disturb the visual field. The inside of the helmet shall be soft. The helmet also shall be esthetically attractive and have a low price. This implies that the manufacturing costs shall be low, and the costs for distribution and storage shall be as low as possible. The lastmentioned requirement can be met when the helmet is made of plate-shaped material portions formed in a special way, which portions the consumer himself can form and fix to suitable size.

Helmets made of plate-shaped material are known previously. A construction, which is particularly suitable for children, is based on the idea that the helmet in unfolded state comprises a number of segments extending from a small central portion, which segments can be bent to the shape of the head so as to form a hood where the ends of the segments are held together by strings or bands. The width of the hood thereby can be changed as the child grows in size. With this construction, there is no continuous protective band about the head. In case of an accident, the segments easily are displaced so that the head more or less is unprotected. Especially when the child has grown in size, interspaces arise between the free ends of the segments.

In another construction, the helmet in unfolded state consists of a perforated plate of special shape with wing-shaped lateral pieces, the free edges of which after the bending of the plate over the top of the head are connected to the free lateral edges of the plate by means of a suitable glue. This helmet, thus, is adjustable only once, and its width cannot be re-adjusted.

Contrary to the aforesaid conventional helmet constructions, the helmet according to the present invention meets all requirements, which a protective helmet for cyclists, skateboard runners, roller skaters and other wearers advancing by own efforts without using motor-driven transportation means must be expected to satisfy. These requirements already are listed above.

BRIEF DESCRIPTION OF THE DRAWINGS

An advantageous embodiment of the invented helmet is described in greater detail in the following, with reference to the accompanying drawings, in which.

DETAILED DESCRIPTION OF THE PREFERRED EMBODIMENT

Figure 2:
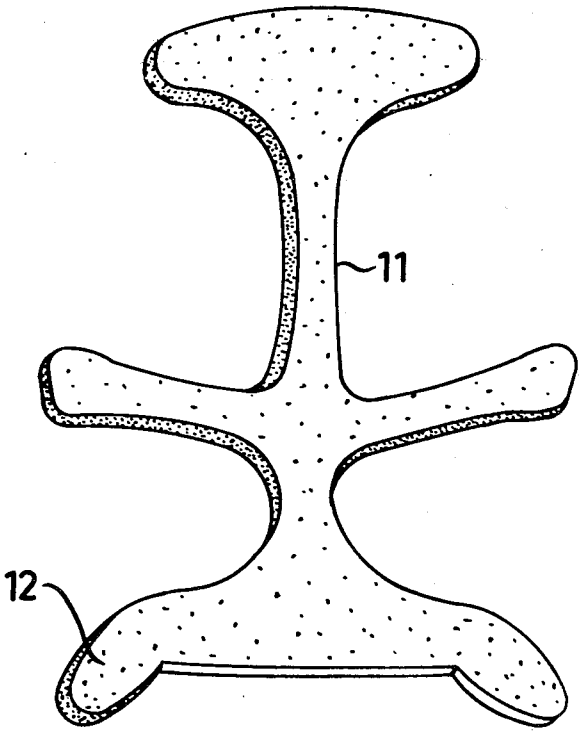
FIG. 2 is a slightly perspective view of the tipped piece of shock-absorbing plate-shaped material which is to be attached on the inside of the shell.
Figure 1:
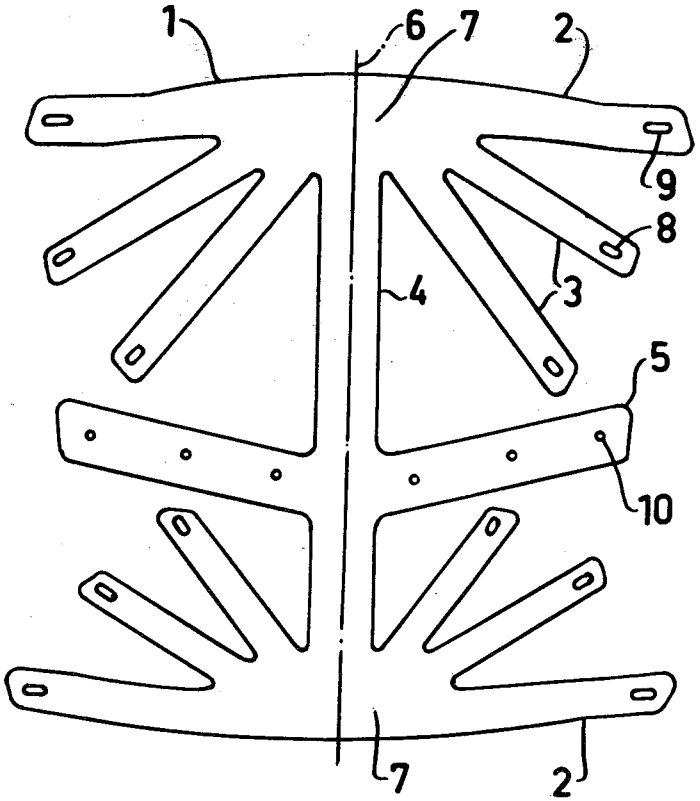
FIG. 1 is a plan view of the tipped piece of plate-shaped material constituting the shell of the helmet.
Figure 3:
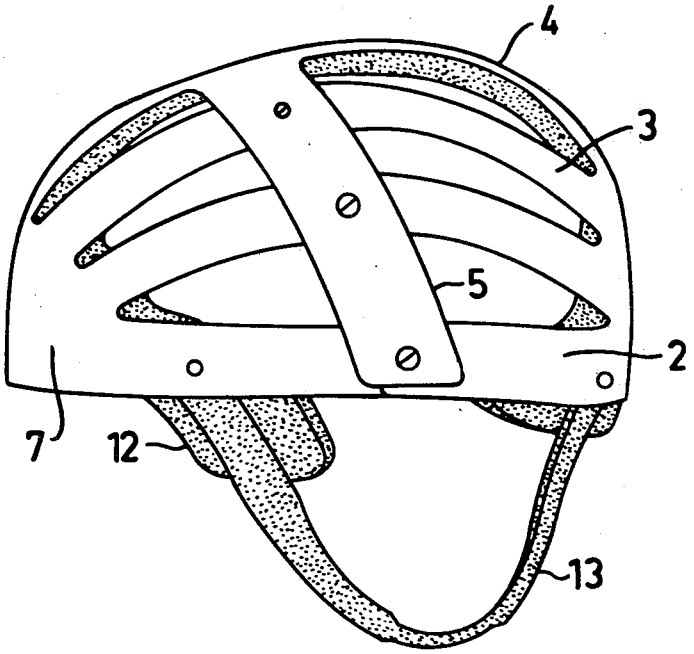
FIG. 3 is a side view of the completely shaped helmet.
Figure 4:
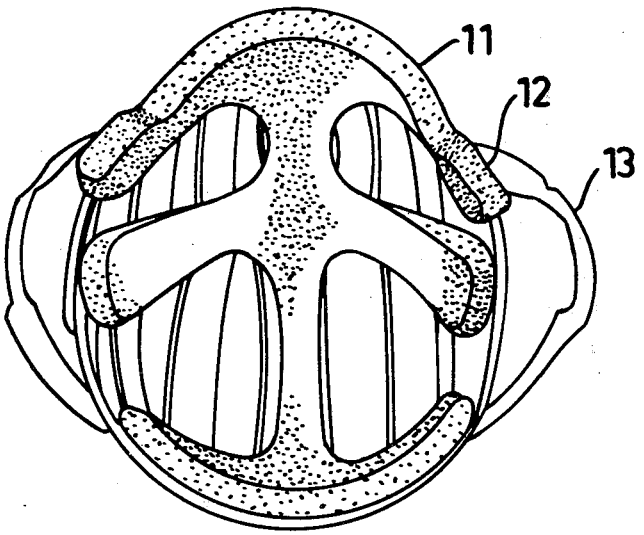
FIG. 4 is a view of the helmet in FIG. 3 seen from below.

At the embodiment shown the helmet according to the invention consists of a piece of hard flexible material, for example plastic, which piece 1 is punched out of a plate and has the form of an I with extended cross-pieces 2. Between the cross-pieces tips 3 are attached and extend extend radiated from the connection between the cross-pieces and the stem 4 of the I. At the center thereof lateral tips 5 are attached and directed one to each side. The tips and lateral tips have band-shape and are arranged symmetrically in relation to a line of symmetry 6 through the stem in its longitudinal direction . Owing to the band-shape, the connection has a certain extension in width, and said portions 7 extended in width will upon mounting of the helmet be located directly in front of the forehead and the back of the head, which thereby are effectively protected. The tips and cross-pieces are provided at their free ends with attachment means 8,9. The two cross-pieces of the I after bending of the stem can be interconnected at the free ends, and the remaining tips are attached with their free ends in pairs to the holders 10 on the lateral tips. In this way, a helmet-like head cover is obtained, which has distance to the head and amply dimensioned slits between the tips, but with tight contact where the requirements for protection are greatest.

The attachment means are designed so that the size of the helmet can be adjusted within certain limits. The adjustment means may be indents and/or holes. For the assembly, for example, screws with flat nuts can be used. For rendering the helmet as comfortable as desired and for effecting necessary shock-absorption, a damping means 11 punched out of plate-shaped material, for example foamed plastic, and formed after extended portions of the shell, lateral tips and stem is placed on the inside of the shell. One of the extended portions of the damping means is provided with lugs 12 of such location as to protect the temples. The damping means is attached in a suitable manner, for example on the stem, and by its elasticity is pressed against the inside of the shell. On the shell also hangers or lugs 13 for chin-bands are attached.

The helmet according to the invention can be varied in its details within the scope of the attached claims. The number of tips and also their shape can be varied, and the attachment means can be designed in different ways without abandoning the basic idea of the invention.

We claim:

1. A helmet, intended for cyclists, skateboard runners, roller skaters and other runners moving by their own efforts, comprising a shell made of a flexible and hard plate-shaped material, the shell in its plane generally having the form of an I with extended cross-pieces and with tips attached so as to radiate between said cross-pieces, the tips extending from the connection between the cross-pieces and a stem of the I, lateral tips attached at approximately the center of the stem to both sides, the cross-pieces and tips being provided with attachment means such that free ends of one cross-piece after a bending of the stem can be connected to free ends of the other cross-piece, free ends of the tips being attached to suitable holders on the lateral tips, and damping means of plate-shaped material formed substantially similar to the stem and the lateral tips, said damping means being placed inside of the completely shaped shell.

2. The helmet as defined in claim 1, wherein the cross-pieces, tips and lateral tips are band-shaped.

3. The helmet as defined in claim 1 or 2 wherein the attachment means are arranged so that the width and size of the shell can be adjusted.

4. The helmet as defined in claim 1, wherein the damping means is provided with lugs to protect the temples of a wearer.

5. The helmet as defined in claim 1, wherein the shell is made of plastic, and the damping means of foamed plastic.

* * * * *